US009373465B1

(12) United States Patent
Yu

(10) Patent No.: US 9,373,465 B1
(45) Date of Patent: Jun. 21, 2016

(54) SWITCH WITH OVERLOAD RELEASE STRUCTURE

(71) Applicant: Tsung-Mou Yu, New Taipei (TW)

(72) Inventor: Tsung-Mou Yu, New Taipei (TW)

( * ) Notice: Subject to any disclaimer, the term of this patent is extended or adjusted under 35 U.S.C. 154(b) by 0 days.

(21) Appl. No.: 14/683,159

(22) Filed: Apr. 10, 2015

(51) Int. Cl.
*H01H 1/00* (2006.01)
*H01H 21/36* (2006.01)
*H01H 21/04* (2006.01)

(52) U.S. Cl.
CPC ..... *H01H 21/36* (2013.01); *H01H 21/04* (2013.01); *H01H 2205/002* (2013.01)

(58) Field of Classification Search
CPC ..... H01H 73/26; H01H 21/36; H01H 21/04; H01H 2205/002
USPC ..... 200/284, 553, 556, 562, 339, 293, 333, 200/529, 552, 558, 559; 337/66, 85, 112, 337/113
See application file for complete search history.

(56) References Cited

U.S. PATENT DOCUMENTS 4,167,720 A 9/1979 Krasser
4,937,548 A 6/1990 Sdunek
5,223,813 A 6/1993 Cambreleng et al.
5,262,748 A 11/1993 Tsung-Mou
5,451,729 A 9/1995 Onderka et al.
5,558,211 A 9/1996 Heydner et al.
6,452,125 B1 * 9/2002 Yu ..... H01H 73/26 200/339
6,525,639 B1 * 2/2003 Cheng ..... H01H 73/26 200/553
6,984,798 B1 * 1/2006 Lu ..... H01H 73/14 200/334
8,729,415 B2 * 5/2014 Chen ..... H01H 23/025 200/315

* cited by examiner

*Primary Examiner* — Edwin A. Leon
(74) *Attorney, Agent, or Firm* — Lin & Associates Intellectual Property, Inc.

(57) ABSTRACT

A switch includes conductive first and second prongs that have upper portions located within a switch casing and lower portions exposed therefrom, a button mounted pivotally on the casing having a protrusion rod and a connection rod connected to the protrusion rod; and an alloy plate disposed within the casing having one end connected securely to the upper portion of the second prong and a free end operably connected to the connection rod. The free end is provided with an upper electrical contact in alignment with a lower electrical contact of the first prong. An elastic member has a first straight abutment portion in resiliently abutment against a fixing element within the casing, a second straight that resiliently abuts against the free end of the alloy plate, whereby, the alloy plate is displaced from its initial position when an overload current flows through the switch in a switch-on position.

6 Claims, 4 Drawing Sheets

SWITCH WITH OVERLOAD RELEASE STRUCTURE

BACKGROUND OF THE INVENTION

1. Field of the Invention

The present invention relates to a switch for controlling a circuit, more particularly to a switch, which has an overload release structure such that in case an overload current flows through the switch in a switch-on position, an alloy plate will be displaced from its initial position because an overload current flows through the switch in a switch-on position so as to prevent the switch from being damaged.

2. The Prior Arts

A conventional switch generally includes a button movable between a switch-on position, where a looped circuit is resulted in the switch so as to permit current flows therethrough, and a switch-off position, where an open circuit is resulted in the switch so that current will not flow therethrough. A majority of the switches presently available are provided with overload release structures, such as by installing fuses or circuit breakers, so as to prevent the switches from being damaged when an overload current flows therethrough.

There are plenty of patents regarding the switches provided with overload release structures. The applicant possesses U.S. Pat. No. 5,262,748 concerning a switch with overload release structure. Some U.S. Pat. Nos. 4,167,720; 4,937,548; 5,223,813; 5,451,729 and 5,558,211 respectively disclose a switch with overload release structure.

A conventional switch with an automatic overload release structure includes a switch casing defining an interior chamber, conductive first, second, third prongs disposed within the interior chamber and having lower prong sections exposed from the switch casing such that the lower prong sections of the first and second prongs are used for electrically connection with the fire and neutral wires of an electrical power source while the lower prong section of the third prong is used for grounding or earthing, wherein the upper prong section of the first prong is provided with a lower electrical contact while the upper prong section of the second prong is connected securely to one end of a heat-deformable alloy plate disposed within the interior chamber. The alloy plate further has a free end provided with an upper electrical contact in alignment with the lower electrical contact. A button is mounted pivotally on the switch casing, includes a connection rod having a barbed lower end operably connected to the free end of the alloy plate. In addition, an elastic member is used for biasing the free end of the alloy plate for retaining the initial position of the alloy plate.

Pressing downward of a first end of the button with respect to the switch casing results in simultaneous downward movement of the connection rod, thereby causing touching between the lower and upper electrical contacts, where a looped circuit is formed between the first and second prongs via the alloy plate such that the button is disposed in a switch-on position. It is to note that the elastic member deforms during touching between the upper and lower electrical contacts until the elastic member retrieves the initial shape or position so as to retain the alloy plate at the initial position.

Pressing downward of a second end of the button with respect to the switch casing results in simultaneous upward movement of the connection rod together with the alloy plate, thereby causing separation between the upper and lower electrical contacts against the biasing action of the elastic member, where an open circuit is formed between the first and second prongs such that the button is disposed in a switch-off position. It is to note that the elastic member deforms during separation between the upper and lower electrical contacts until the elastic member retrieves the initial shape or position so as to retain the alloy plate at the initial position.

One drawback of the above-mentioned switch resides in that in case an overload current flows therethrough and thus results in an overheated situation, the alloy plate deforms due to the temperature of the overheat exceeds the predetermined deformation temperature of the alloy plate. During the deformation, the free end of the alloy plate will deform tremendously and buckles upward, thereby forming an open circuit between the upper and lower electrical contacts. In the same manner, the elastic member deforms simultaneously with the alloy plate until the upper and lower contacts at the free end retrieve to their respective initial position, where the elastic member retains the alloy plate at its initial position.

It is noted that the above-mentioned elastic member is in the form of a leaf spring and hence has a relatively large flexibility, which, in turn, influences the relative movement of the free end of the alloy plate with respect to the conductive first and second prongs, and hence the final precise position of the free end of the alloy plate.

SUMMARY OF THE INVENTION

Therefore, the objective of the present invention is to provide a switch with an automatic overload release structure so as to avoid the possibility occurrence of the above-mentioned problem.

One specific feature of the present invention is to provide a new design of the elastic member for biasing against the alloy plate such that under the principle that without reducing the biasing force of the elastic member, the same has more effective flexibility to permit retrieving the initial position of the alloy plate once released from engagement in case an overload current flows through the switch of the present invention.

A switch with automatic overload release structure of the present invention includes a switch casing, a button and an alloy plate. The switch casing defines an interior chamber with a bottom, includes conductive first and second prongs disposed within the interior chamber and having lower prong portions exposed to an exterior of the interior chamber via the bottom and upper prong portions located within the interior chamber. The upper prong portion of the first prong is provided with a lower electrical contact. The button is mounted pivotally on the switch casing, has a first end provided with a protrusion rod extending into the interior chamber and a connection rod movably connected to the protrusion rod. The alloy plate is disposed within the interior chamber, has one end connected securely to the second prong and a free end operably connected to the connection rod. The free end is provided with an upper electrical contact at a lower surface in alignment with the lower electrical contact of the first prong. An elastic member is used for biasing the free end of the alloy plate, wherein the switch is characterized in that the elastic member has a first straight abutment portion in biasing abutment against a fixing element disposed within the interior chamber, a second straight abutment portion that is parallel to the first straight abutment portion and that abuts biasing against the free end of the alloy plate and a plurality of curved portions interconnecting the first and second straight abutment portions.

In order to provide stably biasing the alloy plate relative to the elastic member, the free end of the alloy plate has upper and lower surfaces provided with upper and lower projection and an abutment recess between the upper and lower projections.

Based on convenient sake in the fabrication and in view of economic points, the upper and lower projections are integrally formed with the upper and lower surfaces of the alloy plate.

In order to stably retain one straight portion of the elastic member within the switch casing, a fixing element is disposed within the switch casing such that the one straight portion of the elastic member is formed with a recess for engaging the fixing element, thereby retaining the elastic member stably in the switch casing.

In one embodiment of the present invention, the fixing element is preferably a fixing screw having a head and a cylindrical shaft formed with an annular groove for engaging the recess of the one straight portion of the elastic member, thereby retaining the elastic member stably in the switch casing.

The switch of the present invention further includes a conductive third prong having a lower prong section exposed to an exterior of the interior chamber via the bottom for grounding.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENT

Figure 1:
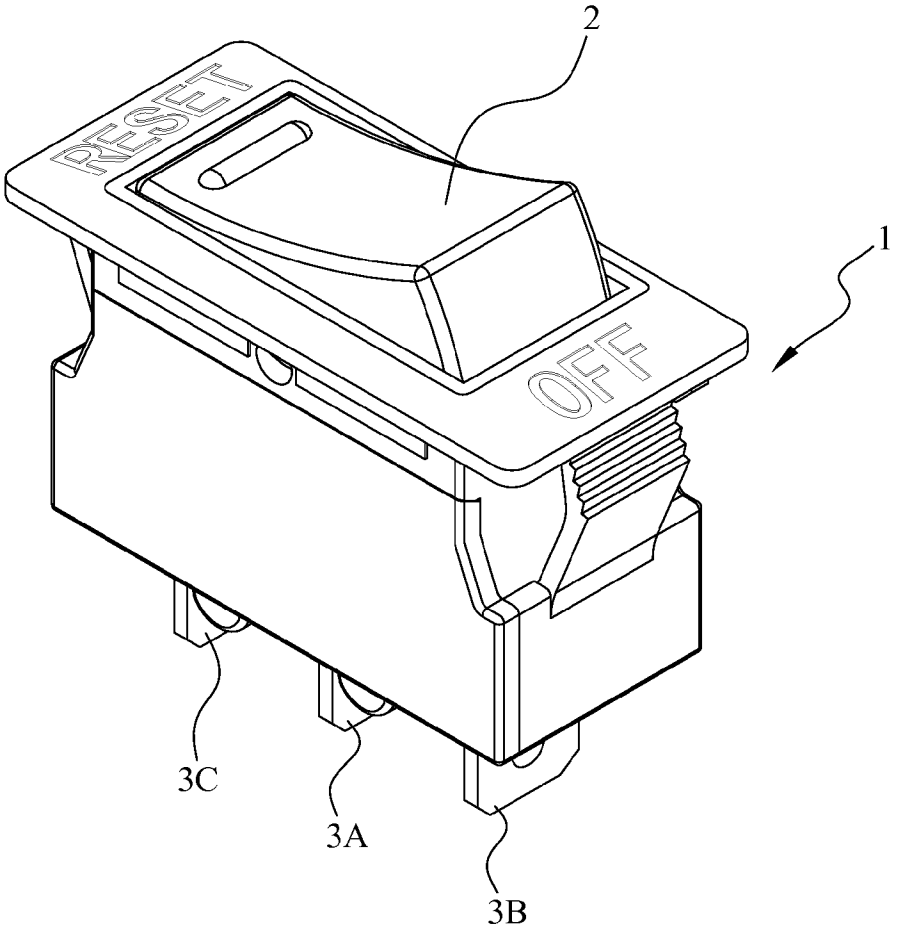
FIG. 1 shows a perspective view of a switch with an overload release structure according to the present invention.
Figure 2:
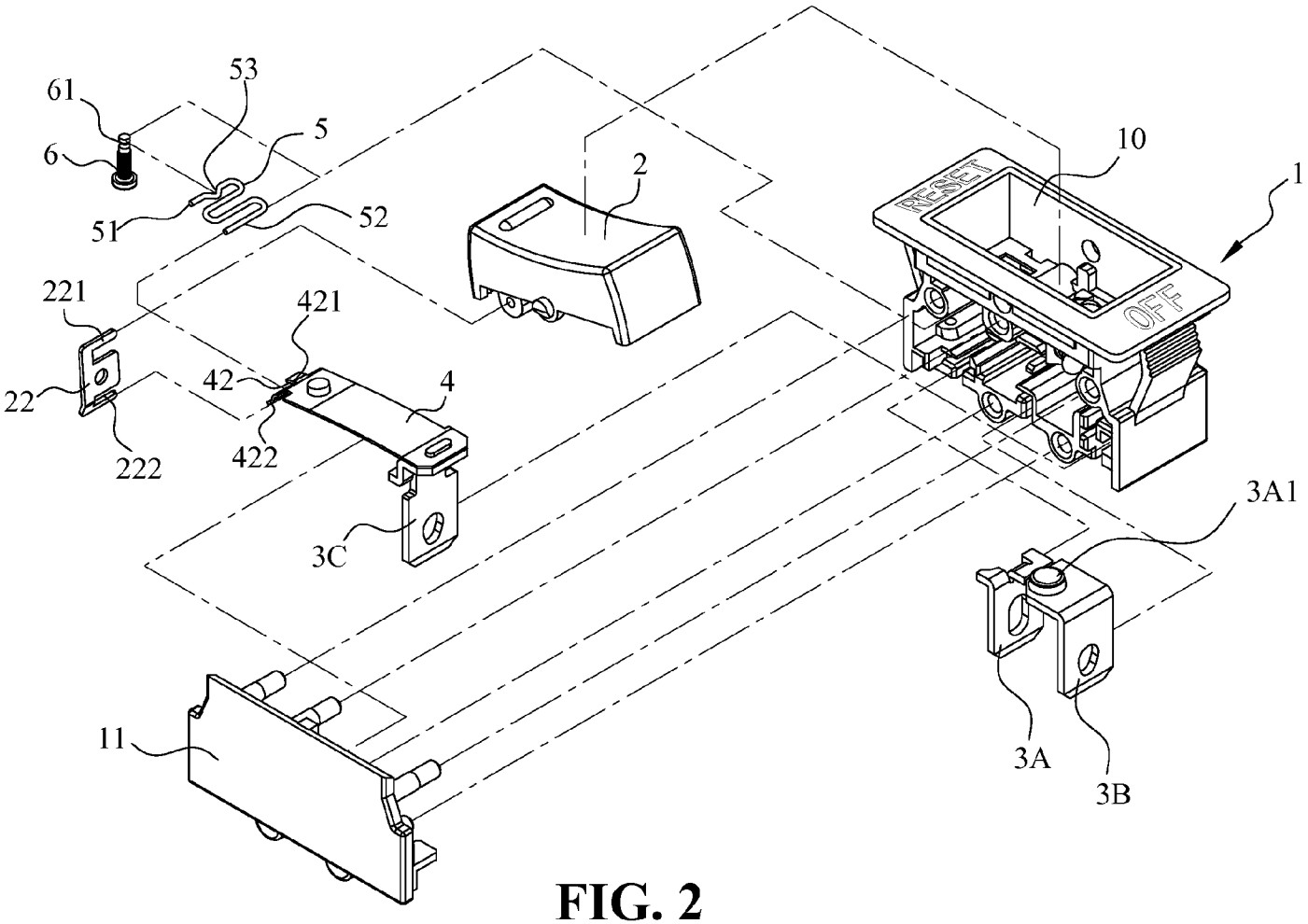
FIG. 2 shows an exploded view of the switch of the present invention.
Figure 3:
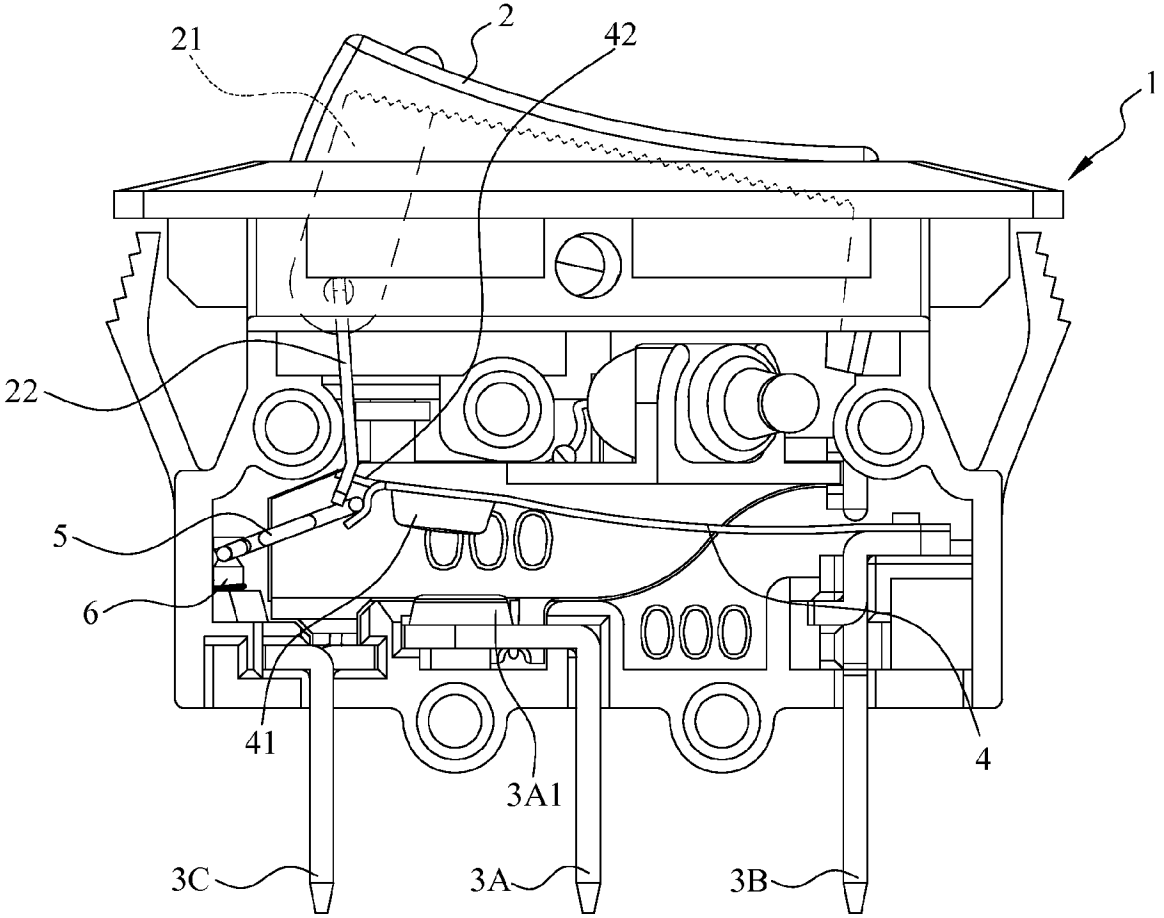
FIG. 3 shows a cross-sectional view of the switch of the present invention in a switch-off position or when an overload current flows therethrough.

Referring to FIGS. 1 to 3, wherein FIG. 1 shows a perspective view of a switch with an overload release structure of the present invention; FIG. 2 shows an exploded view of the switch of the present invention; and FIG. 3 shows a cross-sectional view of the switch of the present invention in a switch-off position or when an overload current flows therethrough. As illustrated, the switch with an overload release structure of the present invention includes a switch casing 1, a button 2, an alloy plate 4 and an elastic member 5. The switch casing 1 defines an interior chamber with a bottom, and includes conductive first and second prongs 3A, 3B that are disposed within the interior chamber and that have lower prong portions exposed to an exterior of the interior chamber via the bottom for electrically coupling to a hot wire and a neutral wire of an electrical power source. The conductive first and second prongs 3A, 3B further have upper prong portions located within the interior chamber. The switch casing 1 further includes a conductive third prong 3C that is disposed within the interior chamber and that has a lower prong portion exposed to exterior of the interior chamber for connecting with the ground. The upper prong portion of the first conductive prong 3A is provided with a lower electrical contact 3A1.

The button 2 is mounted pivotally on the switch casing 1, has a first end provided with a protrusion rod 21 extending into the interior chamber and a connection rod 22 movably connected to the protrusion rod 21, a detailed description will be given in the following paragraphs.

The alloy plate 4 is disposed within the interior chamber below the protrusion and connection rods 21, 22, and has one end connected securely to the upper prong portion of the second prong 3B and a free end operably connected to the connection rod 22. The free end of the alloy plate 4 is provided with an upper electrical contact 41 at a lower surface in alignment with the lower electrical contact 3A1 of the first prong 3A. Preferably, in the present invention, the free end of the alloy plate 4 is punched in such a manner to have upper and lower surfaces provided with upper and lower projections 421, 422 and an abutment recess 42 between the upper and lower projections 421, 422. More preferably, the upper and lower projections 421, 422 are integrally formed on the upper and lower surfaces of the free end of the alloy plate 4. Note the lower barbed portion 222 of the connection rod 22 is hooked to one longitudinal side of the alloy plate 4 while the upper portion 221 of the connection rod 22 (see FIG. 2) extends through a hole in the protrusion rod 21, thereby coupling the alloy plate 4 with the connection and protrusion rods 22, 21.

The elastic member 5 is disposed within the interior chamber of the switch casing 1, has a first portion biasing the free end of the alloy plate 4. To be more specific, the elastic member 5 is an integrally formed piece fabricated from flexible material, and has a first straight abutment portion 51, a second straight abutment portion 52 that is parallel to the first straight abutment portion 51 and that abuts resiliently against the free end of the alloy plate 4, and a recess 53 formed at the first straight abutment portions 51 and a plurality of curved portions interconnecting the first and second straight abutment portions 51, 52 (see FIG. 2). In this embodiment, the elastic member 5 is generally M-shaped with the first straight abutment portion 51, the second straight abutment portion 51 and an intermediate V-shaped portion interconnecting the first and second straight abutment portions 51, 52.

A fixing element 6 is disposed within the interior chamber of the switch casing 1 for positioning the first straight abutment portion 51 of the elastic member 5. In the present invention, a fixing screw serves as the fixing element 6, has a head and a cylindrical shaft formed with an annular groove 61 for engaging the recess 53 of the first straight abutment portion 51 of the elastic member 5 while the second straight abutment portion 52 is in abutment with the abutment recess 42 of the alloy plate 4, thereby resiliently and stably retaining the free end of the alloy plate 4 relative the elastic member 5.

Figure 4:
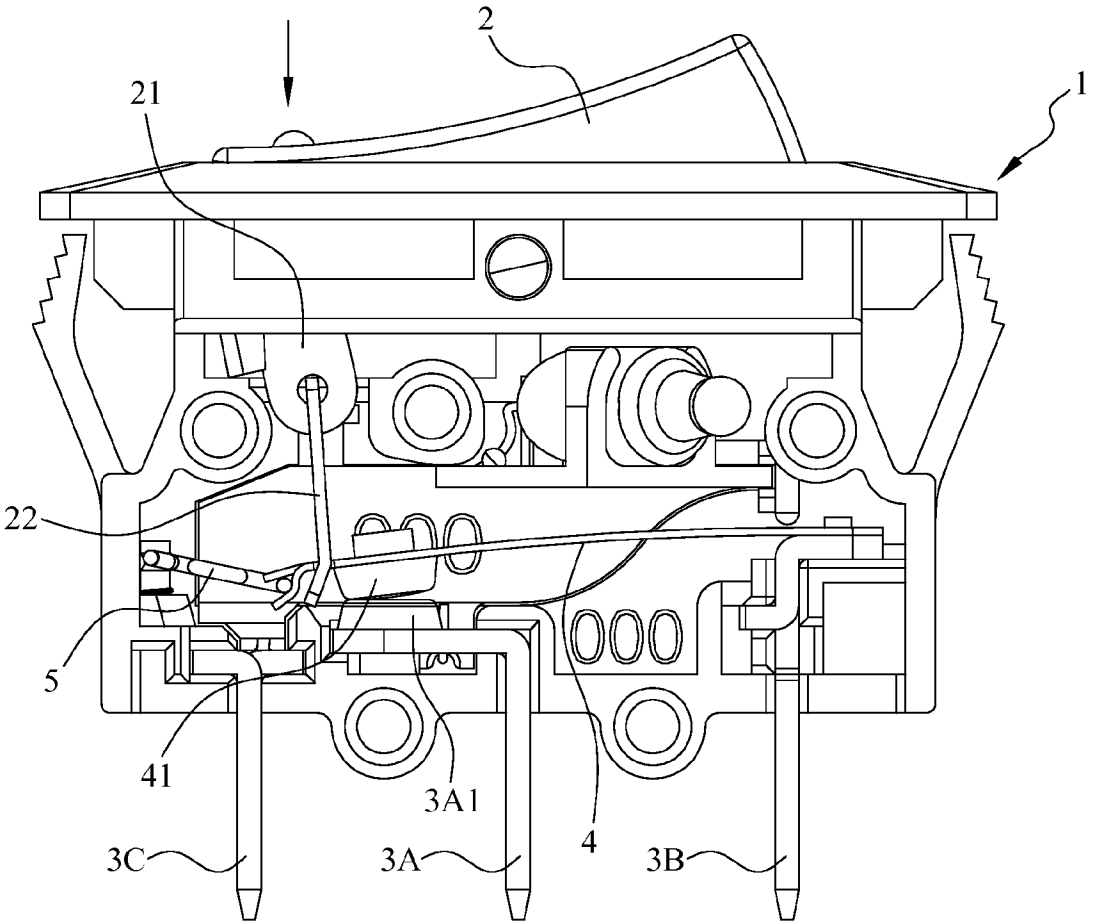
FIG. 4 shows a cross-sectional view of the switch of the present invention in a switch-on position.

After assembly, when the button 2 is switched on, in which the first end of the button 2 is pressed downward relative to the switch casing 1 as shown by the arrow direction (see FIG. 4) results in downward movement of the protrusion and connection rods 21, 22 together with the alloy plate 4, thereby touching the upper and lower electrical contacts 41, 3A1 relative to each other. Note that under this condition, the free end of the alloy plate 4 is stably retained owing to the biasing action of the elastic member 5 and hence a looped circuit is formed between the first and second prongs 3A, 3B via the alloy plate 4 and current can flow therethrough.

When the button 2 is switched off, in which the second end of the button 2 is pressed downward relative to the switch casing 1 in the arrow direction as shown in FIG. 3, which results in upward movement of the protrusion and connection rods 21, 22 while the connection rod 22 raises the alloy plate 4 move together upward, thereby causing separation of the lower electrical contacts 41 of the alloy plate 4 from the upper electrical contact 3A1 of the first prong 3A. Note that simultaneously upward movement of the alloy plate 4 together with the connection rod 22 causes retraction of the elastic member 5 from its initial shape and retrieves its initial shape only when the lower electrical contact 41 entirely disengages from the upper electrical contact 3A1. At this time, an open circuit is established between the first and second prongs 3A, 3B and no current flows therethrough.

As best shown in FIG. 3, when the button 2 is in the switch-on position and (in case of) an overload current flows through the first and second prongs 3A, 3B via the alloy plate 4 results in deformation of the alloy plate 4 from its initial shape upon reaching a default value results in retraction of the elastic member 5 from its initial shape and retrieves its initial shape only when the lower electrical contact 41 entirely disengages from the upper electrical contact 3A1, thereby forming an open circuit between the first and second prongs 3A, 3B and preventing the switch from being damaged. Note that the separation of the upper and lower electrical contacts 41, 3A1 is retained stably owing to the biasing action of the second straight abutment portion 52 of the elastic member 5 at its initial shape against the free end of the alloy plate 4.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A switch with overload release structure comprising:

a switch casing defining an interior chamber with a bottom, having at least conductive first and second prongs exposed to an exterior of the interior chamber via the bottom, the first prong having an upper prong portion disposed within the chamber and provided with a lower electrical contact;

a button mounted pivotally on the switch casing, having a first end provided with a protrusion rod extending into the chamber and a connection rod movably connected to the protrusion rod;

an alloy plate disposed within the interior chamber, having one end connected securely to the second prong and a free end operably connected to the connection rod, the free end being provide with an upper electrical contact in alignment with the lower electrical contact of the first prong; and an elastic member biasing the free end of the alloy plate, wherein the elastic member has a first straight abutment portion in biasing abutment against a fixing element within the interior chamber, a second straight abutment portion that is parallel to said first straight abutment portion and that abuts biasing against the free end of the alloy plate, and a plurality of curved portions interconnecting said first and second straight abutment portions.

2. The switch according to claim 1, wherein the free end of the alloy plate has upper and lower surfaces provided with upper and lower projections and an abutment recess between the upper and lower projections.

3. The switch according to claim 2, wherein the upper and lower projections are integrally formed on the upper and lower surfaces of the free end of the alloy plate.

4. The switch according to claim 1, wherein the first straight abutment portion of the elastic member is formed with a recess for retaining said fixing element.

5. The switch according to claim 4, wherein said fixing element is a fixing screw having a cylindrical shaft formed with an annular groove for engaging with the recess of the first straight abutment portion of the biasing member.

6. The switch according to claim 1, further comprising a conductive third prong having lower prong section exposed to the exterior of the interior chamber via the bottom for grounding.

* * * * *